United States Patent [19]

Osawa et al.

[11] Patent Number: 4,804,995

[45] Date of Patent: Feb. 14, 1989

[54] CHARGED LATENT IMAGE DEVELOPING APPARATUS

[75] Inventors: Shigenobu Osawa, Kawasaki; Taiichi Kawaguchi, Yokohama; Makoto Tamura; Hideyuki Shinohara, both of Tokyo, all of Japan

[73] Assignee: Kabushiki Kaisha Toshiba, Kawasaki, Japan

[21] Appl. No.: 890,919

[22] Filed: Jul. 30, 1986

[30] Foreign Application Priority Data

| | | | |
|---|---|---|---|
| Jul. 31, 1985 | [JP] | Japan | 60-169245 |
| Jul. 31, 1985 | [JP] | Japan | 60-169246 |
| Jul. 31, 1985 | [JP] | Japan | 60-169247 |
| Mar. 6, 1986 | [JP] | Japan | 61-48928 |

[51] Int. Cl.[4] ..... G03G 15/08

[52] U.S. Cl. ..... 355/3 DD; 355/14 D; 118/657

[58] Field of Search ..... 355/3 DD, 14 DD, 10; 118/657–658, 652

[56] References Cited

U.S. PATENT DOCUMENTS

| | | | |
|---|---|---|---|
| 3,580,673 | 8/1968 | Yang | 355/15 |
| 4,213,617 | 7/1980 | Salger | 355/3 DD X |
| 4,391,503 | 7/1983 | Pugh | 118/658 X |
| 4,402,103 | 9/1983 | Yanagawa et al. | 355/15 X |
| 4,563,978 | 1/1986 | Nakamura et al. | 355/3 DD X |
| 4,575,220 | 3/1986 | Sakamato et al. | 355/3 DD |
| 4,588,285 | 5/1986 | Tagoku | 355/3 DD X |
| 4,591,261 | 5/1986 | Saruwatari et al. | 355/3 DD X |
| 4,592,653 | 6/1986 | Ikeda et al. | 355/3 DD |
| 4,607,940 | 8/1986 | Quang | 355/3 DD X |
| 4,615,608 | 10/1986 | Mizutani | 355/3 DD |
| 4,637,706 | 1/1987 | Hosoi et al. | 355/14 D |

*Primary Examiner*—A. C. Prescott
*Assistant Examiner*—Jane Lau
*Attorney, Agent, or Firm*—Finnegan, Henderson, Farabow, Garrett, & Dunner

[57] ABSTRACT

A developing apparatus for developing a charged latent image formed on a photosensitive drum with a developer including toners and carriers comprises a casing for holding the developer, a developing roller for carrying the developer supplied from the casing, and conveying the developer from the casing to the photosensitive drum so as to develop the charged latent image formed on the photosensitive drum with the developer, a doctor blade for controlling the thickness of the developer carried on the developiung roller to a predetermined value, a scraper for removing the developer which keeps on being carried on the developing roller after the end of developing operation, and returning the removed developer into the casing, and a toner removing member for removing toners, directly attached on the developing roller, from the developing roller, the toner removing member being provided independent of the developer removing scraper.

9 Claims, 12 Drawing Sheets

CHARGED LATENT IMAGE DEVELOPING APPARATUS

BACKGROUND OF THE INVENTION

The present invention relates to a developing apparatus causing a developer carrying body arranged in an electronic copying machine to carry a developer and apply it to a charged latent image formed on a surface of an image carrying body, thereby developing the latent image.

A conventional developing apparatus of this type has a developing roller as a developer carrying body in which a plurality of magnetic poles are arranged in a rotating sleeve. A magnetic brush of a developer is formed on the rotary sleeve and is brought into slidable contact with the latent image formed on a photosensitive drum (an image carrying body) upon rotation of the rotating sleeve, thereby developing the latent image on the photosensitive drum.

The magnetic poles of the developing roller can be shifted in the radial direction with respect to the rotating sleeve. The magnetic poles are displaced in the radial direction with respect to the rotating sleeve in a development stop state so that conveyance of the developer is stopped.

In the conventional developing apparatus having the arrangement described above, conveyance of the developer is stopped by only radial displacement of the magnetic poles. For this reason, developer conveyance cannot be surely interrupted due to ambient conditions, fatigue of developer, and density of developer, thereby degrading the reliability of the developing apparatus. In particular, when developing rollers are vertically aligned in a plurality of stages, as in a color copying machine, developer which falls from an upper developing roller is attached to a lower developing roller and contaminates the latent image on the photosensitive drum. In addition, the developer is kept attached to the developing roller and is stacked thereon to disable further generation of a developing bias voltage thereon. As a result, the density of an image formed on the photosensitive drum is lowered to result in an unclear, fogged image. In addition, the magnetic characteristics of the developer used in the developing apparatus are limited to narrow the selection range for developing materials of developer.

A so-called reversal developing type developing apparatus has been recently used to perform a reversal development which is opposite to a normal development according to normal electrophotographic techniques. The reversal developing type developing apparatus develops light and dark portions in an original into dark and light portions in a printing, respectively. The conventional reversal developing type developing apparatus is used in a copying printer with the copying machine function and the printer function, a microfilm reader/printer, or a laser printer.

When a conventional electrophotographic process according to the Carlson method is used in a conventional reversal developing type developing apparatus of this type, the following problems are presented.

In reversal development, at first a photosensitive drum as an image carrying body is positively charged at a surface potential of 800 V and, then, the surface potential of a region corresponding to a bright portion of a negative original is decreased by radiation with light. A positively charged toner is attached to the exposed portion to develop the latent image. For this reason, if an original is a drawing (most of the area is a bright or light portion), the surface potential in the most surface area of the photosensitive body does not decrease in reversal development but is kept high. A developing bias voltage of the developing roller as the developer carrying body for carrying and conveying the developer is a maximum of about 500 V due to the problems of the electrostatic characteristics of the photosensitive body, the withstand voltage, and background fogging. For this reason, a strong electric field from the high-potential photosensitive body to the developing roller is formed. The positively charged toner is then attracted to the developing roller in the electric field, thereby forming a toner layer on the outer surface of the developing roller. Once the toner layer is formed, it repeatedly passes through the electric field by rotation of the developing roller and is increased in the thickness. A large local voltage drop also occurs at contact points between individual toner particles in the toner layer, between the toner and the surface of the developing roller, or between the toner layer and the toner carrier. Therefor, positive and negative charges are stored at both sides of each contact point due to dielectric polarization (i.e., a kind of capacitor is formed). A high electric field is formed at the contact point as a boundary, and a strong cohesion force acts between the toner particles due to the Johnsen-Rahbech effect caused by the strong Maxwell distorsion force.

When a solid black image (an image consisting of only a black portion) is developed by reversal development, the density of an edge portion (i.e., an image boundary) in the image is higher than that of the central portion, thus resulting in a so-called edge effect. In order to reduce the edge effect to obtain an image having a uniform density, a toner having a relatively low charging level is used.

However, when such a toner is used, the toner layer tends to be formed on the outer surface of the developing roller and affects the development performance. A typical example of such an unfavorable influence is the lowing of the developing power (that is, the lowing of the density of an image) caused by the accumulation electric charge on the toner layer formed on the developing roller when the developer comprises a one-component developer (specially, a nonmagnetic toner). On the other hand, if a two-component developer consisting of a toner and a carrier is used, a toner layer is formed on the developing roller by the toner separated from the carrier. The toner layer serves as an insulating layer and disables generation of the developing bias voltage. As a result, the image developed on the surface of the photosensitive drum has a low density, resulting in an unclear, fogged image.

SUMMARY OF THE INVENTION

The present invention has been made in consideration of the above situation, and has as its first object to provide a developing apparatus for preventing a developer layer from being formed on a surface of a developer carrying body, and for producing a clear image developed on a surface of a photosensitive drum.

In order to achieve the first object of the present invention, there is provided a developing apparatus for developing a charged latent image formed on an image carrying body with a developer including toners and carriers, comprising: a casing for holding the developer;

a developer carrying body for carrying the developer supplied from the casing, and conveying the developer from the casing to the image carrying body so as to develop the charged latent image formed on the image carrying body with the developer; means for controlling the thickness of the developer carried on the developer carrying body to a predetermined value; means for removing the developer which keeps on being carried on the developer carrying body after the end of developing operation, and returning the removed developer to the casing; and means for removing toners, directly attached on the developer carrying body, from the developer carrying body, the toner removing means being provided independent of the developer removing means.

It is a second object of the present invention to provide the developing apparatus achieving the first object described above, wherein conveyance of the developer by the developer carrying body can be surely stopped without being influenced by ambient conditions, fatigue of the developer, or density of the developer at a developer conveyance stop timing, and magnetic characteristics of a developer used in the apparatus are not limited.

In order to achieve the second object of the present invention, there is provided the developing apparatus achieving the first object described above, wherein the developer carrying body has a plurality of magnetic poles for carrying and conveying the developer, the magnetic poles are movable between a first position for conveying the developer and a second position to stop the conveyance of the developer, the toner removing means faces one of the magnetic poles when the magnetic poles are disposed at the second position, the toner removing means has a magnet spaced a predetermined away from the developer carrying body so as to aim a polarity opposite to that at the facing side of the one magnet pole toward the facing side polarity of the one magnetic pole, and the magnet cooperates with the one magnetic pole, moved from the first position to the second position when the conveyance of the developer is stopped, so as to attract the developer carried on the developer carrying body.

The first object of the present invention stated above is also achieved in a case of that the developing apparatus is a reversal developing type developing apparatus in which light and dark portions in original are developed into dark and light portions in the charged latent image, respectively.

The reversal developing type developing apparatus can achieve more effectively the first object of this invention than the ordinary type developing apparatus.

In the developing apparatus achieving the first object of the present invention, the toner removing means may include a toner scraping member which is brought into contact with the developer carrying body to scrape off the toner directly attached to the developer carrying body. The toner scraping member has a simple structure and surely scrapes off the toner directly attached to the developer carrying body.

Better scraping efficiency can be achieved when the toner scraping member is located downstream of the developer removing means in the developer conveying direction of the developer carrying body.

In the developing apparatus achieving the first object of the present invention, the toner removing means may include a magnetic member slightly spaced apart from the developer carrying body to attract the toner, directly attached on the developer carrying body, from the developer carrying body.

Also, in this case, in order to improve attracting efficiency for the toner, it is preferable that the magnetic member is located downstream of a developing position, where the developer carrying body makes the developing operation to the image carrying body, in the developer conveying direction of the developer carrying body. If the developer carrying body has a magnetic pole for carrying and conveying the developer, it is preferable that the magnetic member faces the magnetic pole.

Further, in the developing apparatus achieving the first object of the present invention, the toner removing means may include an electrode member slightly spaced apart from the developer carrying body, and means for applying voltage to the electrode member in order to attract the toner, directly attached to the developer carrying body, from the developer carrying body to the electrode member.

Also, in this case, in order to improve attracting efficiency for the toner, it is preferable that the voltage applying means applies AC voltage to the electrode member, and that the electrode member is located downstream of a developing position, where the developer carrying body makes the developing operation to the image carrying body in the developer conveying direction of the developer carrying body. Similarly, if the developer carrying body has a magnetic pole for carrying and conveying the developer, it is preferable that the electrode member faces the magnetic pole in order to improve attracting efficiency of the toner.

Said voltage applying means may apply a voltage to the electrode member to generate an electric field between the electrode member and the developer carrying body, the electric field having a polarity opposite to that of the electric field generated between the developer carrying body and the image carrying body.

In this case, it is preferable that the voltage applying means applies a voltage, having a polarity opposite to that of a developing bias potential applied to the developer carrying body to the electrode member, and that the voltage applying means grounds the electrode member.

If the toner removing means, as stated above, includes the electrode member and the voltage applying means, the electrode member may be constituted by part of the casing.

By constituting the electrode member as described above, the structure of the developing apparatus can be simplified.

DETAILED DESCRIPTION OF THE PREFERRED EMBODIMENTS

Figure 1:
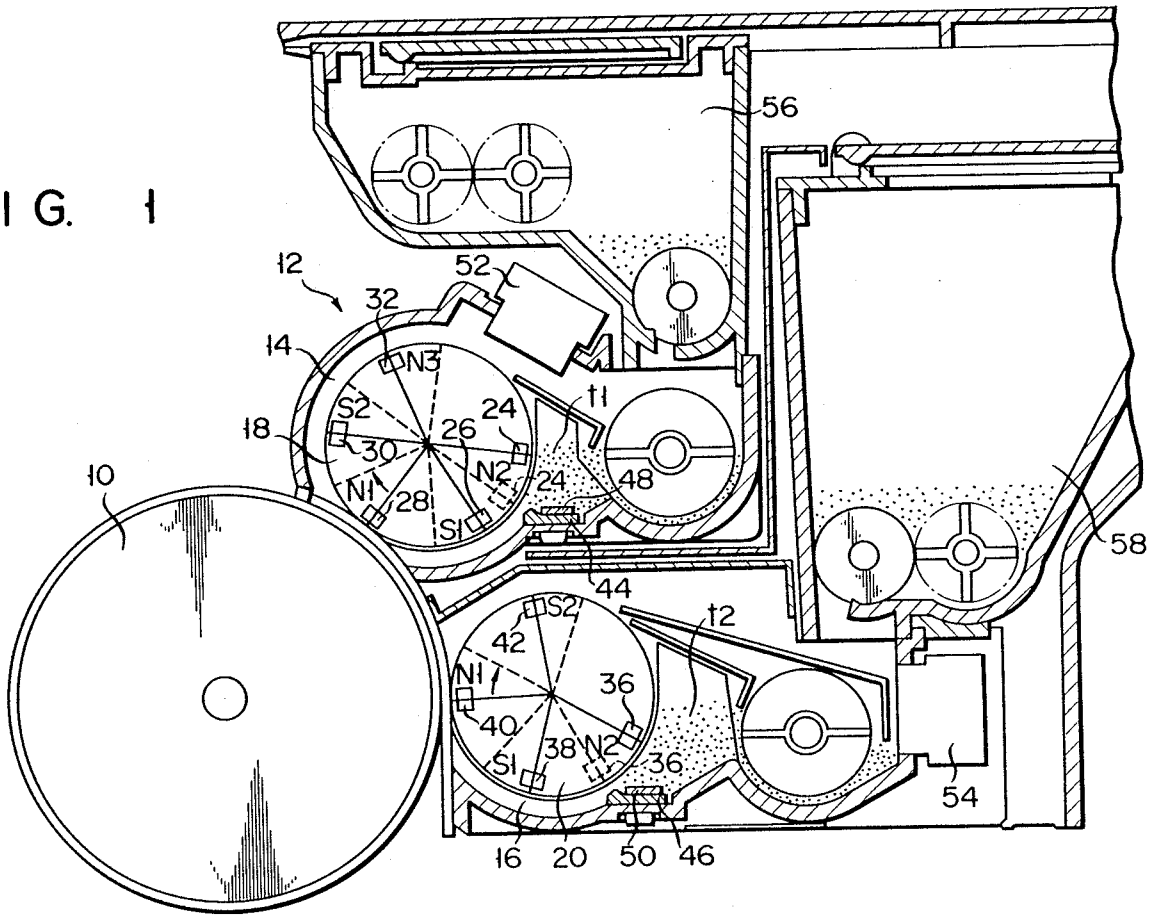
FIG. 1 is a longitudinal sectional view schematically showing a copying machine having a developing apparatus according to a first embodiment of the present invention.
Figure 2:
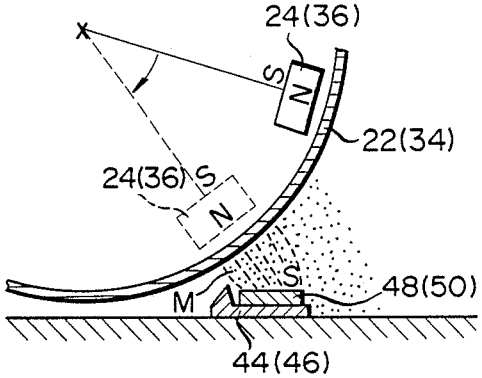
FIG. 2 is a longitudinal sectional view schematically showing a state wherein conveying of the developer from a developing roller as a developer carrying body to a photosensitive drum as an image carrying body is stopped at the developing operation stop timing in the developing apparatus in FIG. 1.

A first embodiment of the present invention will be described with reference to FIGS. 1 and 2.

Reference numeral 10 denotes a photosensitive drum as an image carrying body arranged in a copying machine. Developing apparatus 12 is arranged adjacent to drum 10. Developing apparatus 12 consists of upper developing unit 14 (for red) and lower developing unit 16 (for black). Developing rollers 18 and 20 are disposed as a developer carrying body in units 14 and 16. Roller 18 comprises rotating sleeve 22 (FIG. 2) and first to fifth magnetic poles 24 to 32 arranged therein. Magnetic poles 24 to 32 are positioned as indicated by the solid lines when developer (red magnetic toner) t1 is conveyed. However, when developer t1 is not conveyed, poles 24 to 32 are shifted to positions, indicated by broken lines, by a solenoid (not shown) relative to sleeve 22. In first, third, and fifth magnetic poles 24, 28, and 32, N poles are positioned near sleeve 22. In second and fourth magnetic poles 26 and 30, S poles are positioned near sleeve 22. Lower developing roller 20 comprises rotating sleeve 34 (FIG. 2) and first to fourth magnetic poles 36 to 42 arranged therein. Magnetic poles 36 to 42 are positioned as indicated by the solid lines when developing agent (black magnetic toner) t2 is conveyed. However, when developer t2 is not conveyed, they are shifted to positions, indicated by broken lines, by a solenoid (not shown) relative to sleeve 34. In first and third magnetic poles 36 and 40, N poles are positioned near sleeve 34, and in second and fourth poles 38 and 42, S poles are also positioned near sleeve 34.

Doctor blades 44 and 46 are disposed at the bottoms of casings of developing units 14 and 16, respectively. Blades 44 and 46 keep the thicknesses of developers t1 and t2 attached to the outer surfaces of rollers 18 and 20 constant. Magnets 48 and 50 are arranged on the upper surfaces of blades 44 and 46, respectively. When the developer is not conveyed, poles 24 and 36 are shifted to positions in which poles 24 and 36 face magnets 48 and 50, as is shown in FIG. 1 by broken lines. Outside surface portions of magnets 48 and 50 having a polarity (S pole) oppose outside portions having the opposite polarity (N pole) of poles 24 and 36. In this embodiment, the surface magnetic flux density of each of magnets 48 and 50 is about 100 Gauss, and is preferably about 50 Gauss or more.

Reference numerals 52 and 54 denote developer density detectors for detecting densities of developers t1 and t2 in units 14 and 16, respectively; and 56 and 58, developer supplying hoppers for supplying developers t1 and t2.

If development with a red toner is performed in the copying machine having the developing apparatus according to the first embodiment, sleeve 22 in developing roller 18 in upper developing unit 14 is rotated clockwise together with first to fifth magnetic poles 24 to 32. The thickness of developer t1 attached to the outer surface of sleeve 22 is kept constant by means of doctor blade 44, and developer t1 is conveyed toward drum 10. Developer t1 on the outer surface of sleeve 22 constitutes a developing brush. The brush is brought into slidable contact with the latent image formed on the surface of drum 10, thereby forming a red toner image.

After development with the red toner is completed, poles 24 to 32 of roller 18 are shifted to the positions relative to sleeve 22, as indicated by the broken lines. As best shown in FIG. 2, first pole 22 comes very close to magnet 48 of blade 44 so that strong magnetic flux M is formed between pole 22 and magnet 48. Flux M prevents developer t1 from being moved to drum 10 through a gap between blade 44 and roller 18.

On the other hand, if black toner development is to be performed, upper developing unit 14 stops conveying developer t1. Sleeve 34 in unit 16 is rotated clockwise together with first to four magnetic poles 36 to 42. The thickness of developer t2 applied to the outer surface of sleeve 34 is made uniform by blade 46. Developer t2 is then conveyed toward drum 10. Developer t2 on the outer surface of sleeve 34 constitutes a developing brush. The brush is brought into slidable contact with the latent image formed on the surface of drum 10, thereby forming a black toner image.

After development with the black toner is completed, first to fourth magnetic poles 36 to 42 of roller 20 are shifted to the positions relative to sleeve 34, as indicated by the broken lines. In this case, as best shown in FIG. 2, first pole 36 comes very close to magnet 50 of blade 46 so that strong magnetic flux M is formed between pole 36 and blade 46. Flux M prevents agent t2 from being moved to drum 10 through a gap between blade 46 and roller 20.

As is apparent from the above description, when developer t1 or t2 is not conveyed, flux M prevents developer t1 or t2 from being moved to drum 10. Therefore, conveyance of developers t1 and t2 toward drum 10 can be completely stopped without being influenced by ambient conditions, degree of fatigue of developer, or density of developer. In addition, the magnetic characteristics of developer used in developing apparatus 12 are not limited, thereby expanding the degree of freedom in a development of materials of developer.

A second embodiment of the present invention will be described with reference to FIGS. 3 to 5.

Figure 3:
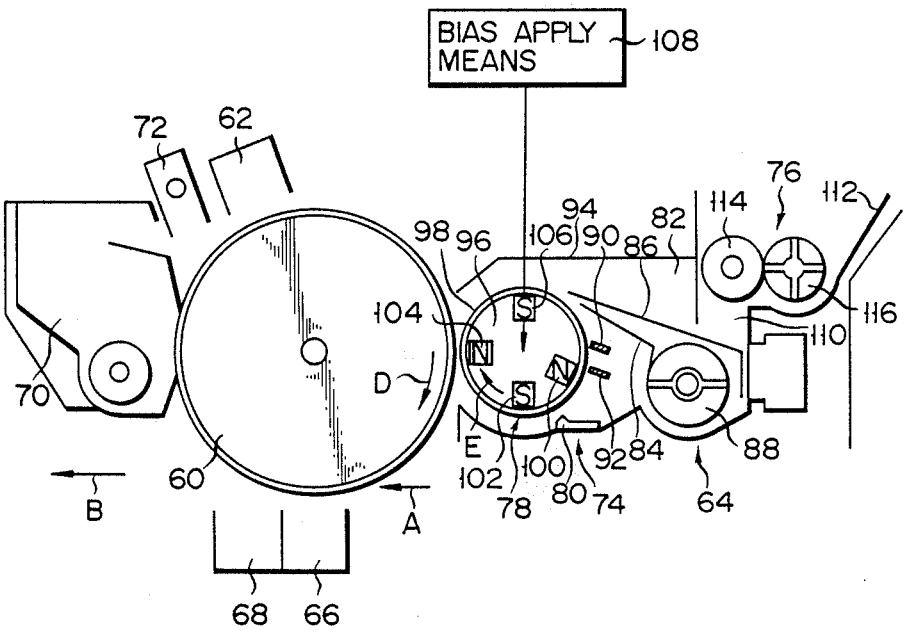
FIG. 3 is a longitudinal sectional view schematically showing an image forming apparatus having a reversal developing type developing apparatus according to a second embodiment of the present invention.

FIG. 3 is a longitudinal sectional view schematically showing an image forming apparatus having a reversal developing type developing apparatus according to the second embodiment of the present invention. The image forming apparatus in FIG. 3 develops a negative original image to a positive toner image and transfers the positive toner image to a recording medium such as paper.

As shown in FIG. 3, photosensitive drum 60 as an image carrying body is located at the center of the housing of the image forming apparatus. Charging charger 62, reversal developing type developing apparatus 64 according to the second embodiment of the present invention, transfer charger 66, separating charger 68, cleaning unit 70, and discharge lamp 72 are sequentially arranged around drum 60.

When drum 60 is rotated clockwise, as indicated by the direction of arrow D, the surface of drum 60 is charged by charger 62 to a uniform surface potential of 800 V. The charged surface of drum 60 is irradiated with a laser beam corresponding to a desired symbol (characters and numeral values) or graphic pattern, light reflected by a negative original image, or light transmitted therethrough. The surface potential at the irradiated or exposed portion of the surface of drum 60 is decreased so that a charged pattern latent image corresponding to the character or graphic pattern or the original image is formed on the surface of drum 60. Reversal developing type developing apparatus 64 (its structure will be described in detail later) applies a positively charged toner to the latent image on the surface of drum 60, thereby visualizing the latent image as a positive toner image.

A paper sheet as a recording medium is fed from a paper cassette (not shown) in the direction of arrow A, in synchronism with rotation of drum 60. The toner image on the surface of drum 60 is transferred by transfer charger 66 to the surface of the recording medium. Thereafter, the recording medium is separated from the surface of drum 60 by separating charger 68 and is conveyed along the direction of arrow B while the transferred image is fixed by a heat roller (not shown). The recording medium with a fixed image is then delivered into a delivery tray (not shown). After transfer and separation operations are completed, residual toner particles are removed from the surface of drum 60 by cleaning unit 70. An after image is eliminated from the surface of drum 60 by discharge lamp 72. Therefore, drum 60 is prepared for the next copying cycle.

The structure and operation of reversal developing type developing apparatus 64 will be described in detail. Developing apparatus 64 consists of developing mechanism 74 near drum 60 and toner supplying unit 76 away from drum 60. Casing 94 of developing mechanism 74 accommodates developing roller 78 as a developer carrying body, doctor blade 80 for controlling the thickness of a developer magnetic brush formed on the surface of roller 78, first and second scrapers (developer removing means) 84 and 86 for scraping the developer magnetic brush (constituted by the magnetic carrier and the nonmagnetic toner attached to the carrier) left on the surface of roller 78 after completion of development and for recovering the removed toner to developer storage 82, developer stirring means 88 disposed in storage 82, and toner removal members (toner removal means) 90 and 92 arranged near around the outer surface of roller 78.

Developing roller 78 consists of magnetic roller 96 and rotating sleeve 98 concentric with and outside of roller 96, and rotated clockwise in the direction of the arrow E. Roller 96 has first to fourth magnetic poles 100 to 106. N poles of first and third magnetic poles 100 and 104 are positioned near sleeve 98, and S poles of second and fourth magnetic poles 102 and 106 are also positioned near sleeve 98. Blade 80 is located at a substantially intermediate position between poles 100 and 102 to face the outer surface of sleeve 98. A developing bias voltage of about 400 V is applied by bias applying means 108 to roller 78. Switching of the voltage applied from bias applying means 108 can be performed. In this embodiment, if drum 60 is positively charged, a positive voltage is applied to the surface of sleeve 98. However, if drum 10 is negatively charged, a negative voltage is applied to the surface of sleeve 98.

A two-component developer consisting of a nonmagnetic positively chargeable toner and a magnetic ferrite carrier is filled in storage 82. The developer particles are attached by the magnetic force of poles 100 to 106 on the surface of sleeve 98, and are aligned on the surface of sleeve 98 along the magnetic flux, thereby constituting a developer magnetic brush. Sleeve 98 is rotated about roller 78 so that new developer are always supplied to fourth magnetic pole 106 aligned with the developing position.

Toner removal members 90 and 92 can be made of polyethylene, polyethlene-terephthalate, urethane rubber or steel. Toner removal members 90 and 92 are brought into slidable contact with sleeve 98 at their tips to scrape the toner from the surface of sleeve 98.

Figure 4:
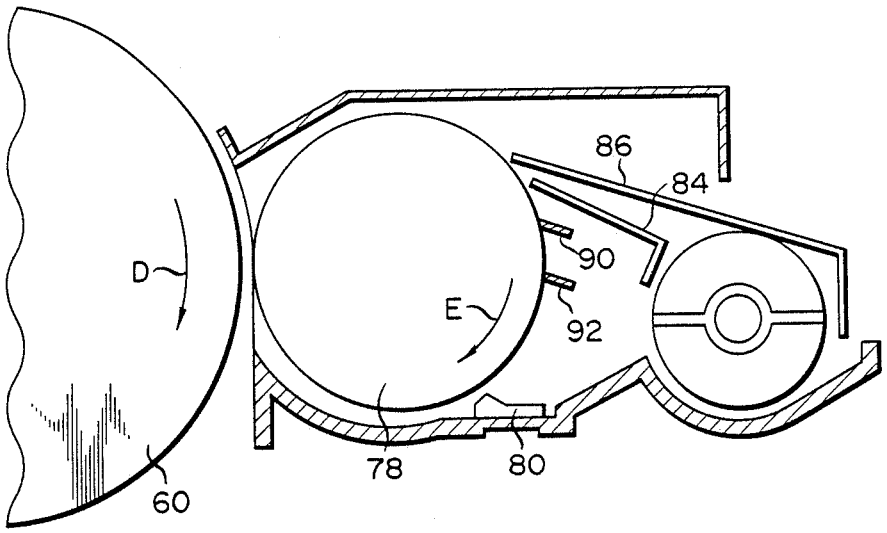
FIG. 4 is a longitudinal sectional view schematically showing the relative positional relationship between the developing roller as a developer carrying body and a toner removal member as a toner scraping member according to a third embodiment of the present invention.
Figure 5:
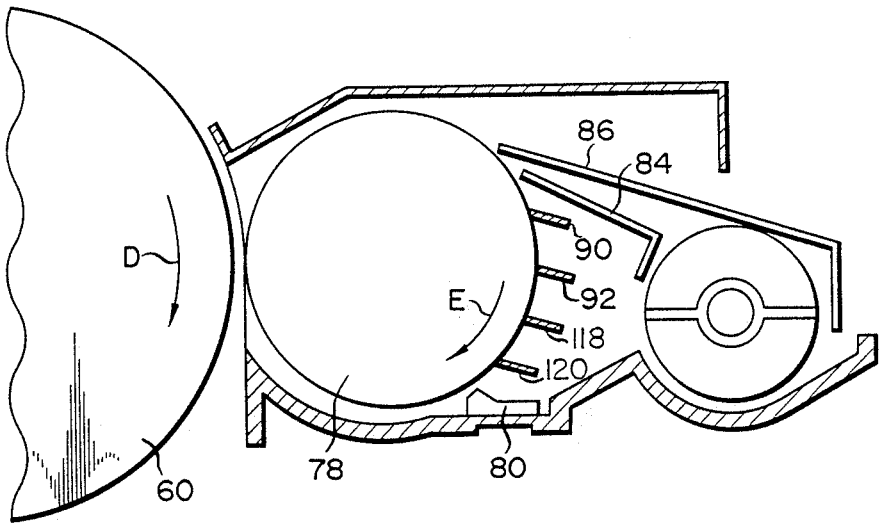
FIG. 5 is a longitudinal sectional view which is the same view as in FIG. 4, schematically showing a modification of the disposition of the toner removal member.

FIG. 4 schematically shows an enlarged area near sleeve 98 and toner removal members 90 and 92 in FIG. 3. Referring to FIG. 4, toner removal members 90 and 92 are located downstream of first and second scrapers 84 and 86 along the developing agent conveying direction of developing roller 78 for the following reason. Since toner removal members 90 and 92 remove or scrape the residual toner particles after scrapers 84 and 86 scrape carriers, more effective toner removal from the surface of roller 96 can be achieved.

Toner supplying unit 76 for supplying developing mechanism 74 with toner comprises hopper 112 whose toner supplying port 110 faces developer storage 82, toner supplying roller 114 disposed to cover port 110 within hopper 112, and stirring roller 116 for stirring the toner in hopper 112 so as to shift it toward roller 114.

The operation of the reversal developing type developing apparatus having the construction described above will be described hereinafter.

Drum 60 is positively charged by charging charger 62 (FIG. 3) to a surface potential of about 800 V. The original is exposed with light and the surface potential of an irradiated portion (an image portion) on the surface of drum 60 corresponding to the image of the original is decreased. The nonirradiated portion of the surface of drum 60 keeps the surface potential of 800 V. A charged pattern is formed on drum 60 according to a normal negative original mainly having symbols (e.g., characters and numerals) and spaces therebetween constituting a nonimage portion.

In developer storage 82 of reversal developing type developing apparatus 64, the toner and the carrier are brought into sufficient contact by the behavior of developer stirring means 88 and the rotation of sleeve 98. The toner is positively charged and the carrier is negatively charged according to their friction charging characteristics. The developer consisting of the toner and carrier particles is aligned on the outer surface of sleeve 98 according to the magnetic flux formed by the magnetic force of poles 100 to 106, thereby constituting a developer magnetic brush. The thickness or height of the developer magnetic brush is controlled by doctor blade 80 to be uniform. More developer particles are sequentially conveyed by roller 78 toward drum 60 upon rotation of sleeve 98. When the developer particles on sleeve 98 reach a position opposite the charged pattern on drum 60, the positively charged toner particles are attracted by Coulomb force to the lower potential area (i.e., the irradiated portion) on drum 60. Therefore, positive development is performed for the charged pattern obtained from the negative original.

In the above reversal development, most of the surface of drum 60 is constituted by the nonimage portion which maintains the surface potential of 800 V, and an electric field is formed by high-potential drum 60 in a direction toward roller 78, to which a developing bias of 400 V is applied. The positively charged toner particles in the developer magnetic brush formed on roller 78 are attracted toward roller 78 in the electric field, thereby adhering the toner particles on roller 78. If this effect is continued by rotation of sleeve 98, the toner particles attached to sleeve 98 pass through the electric field for a plurality of times. The toner layer is thus formed on the surface of sleeve 98, and the thickness of the toner layer is increased, thereby causing the disadvantages described in "Background of the Invention".

According to the apparatus of this embodiment, the above drawbacks are prevented as follows. First and second toner removal members 90 and 92 are brought into slidable contact with the surface of sleeve 98 to forcibly separate the toner particles therefrom. As a result, neither the toner layer is formed on the surface of roller 78 nor the thickness of the toner layer is increased.

Toner removal members 90 and 92 in FIG. 4 have a rectangular shape. The distal ends of members 90 and 92 are in slidable contact with rotating sleeve 98 in developing roller 78 for an interval of about 3 mm. The toner particles strongly attracted to the surface of sleeve 98 in roller 78 by the electric field formed between drum 60 and roller 78 cannot be completely removed by conventional first and second scrapers 84 and 86. Therefore, as shown in FIG. 4, first and second toner removal members 90 and 92 are in slidable contact with the outer surface of roller 78 to forcibly separate or remove the toner particles from the surface of roller 78.

The latent image development in the image forming apparatus having the arrangement as described above provides a high-contrast image without an edge effect often found in a solid black image. In addition, when continuous copying is performed by the image forming apparatus, the initial copying result can be maintained. It is thus found that an insulating film caused by a toner layer is not formed on the outer surface of sleeve 98 in roller 78.

Various modifications may be made in the second embodiment of the present invention. For example, the number of toner removal members for each developing roller 78 is not limited to one or two. As shown in FIG. 5, four toner removal members 90, 92, 118, and 120 may be arranged. If the toner removal members are made of a conductive material, an AC power source may be used to apply an AC voltage to the toner removal members. A Coulomb force generated between the toner removal members and the toner particles attached to the developing roller as the developer carrying means improves removal of the toner from the surface of roller 78.

The present invention is particularly effective to prevent drawbacks in the reverse developing type developing apparatus. However, the toner removal members of this embodiment can also be applied to a normal developing apparatus to obtain a clearer image.

Figure 6:
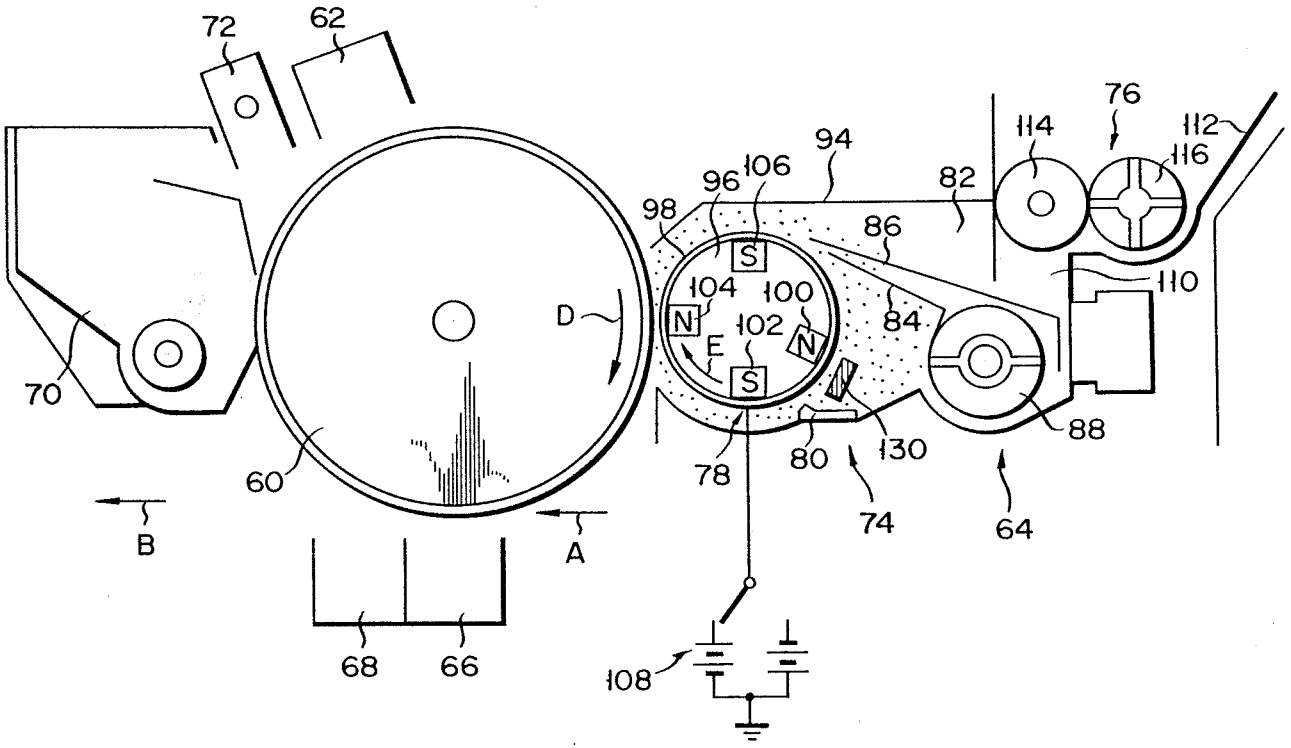
FIG. 6 is a longitudinal sectional view schematically showing an image forming apparatus having a reversal developing type developing apparatus according to the third embodiment of the present invention.
Figure 7:
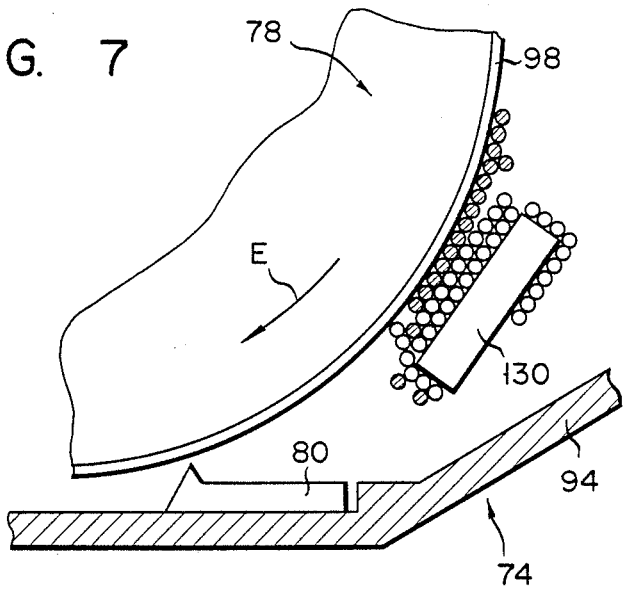
FIG. 7 is an enlarged longitudinal sectional view schematically showing only a portion near around a magnetic member in the reversal developing type developing apparatus according to the third embodiment, so as to explain a toner scraping function for scraping a toner from the surface of the developing roller as the developer carrying body to which the toner is directly attached.
Figure 8:
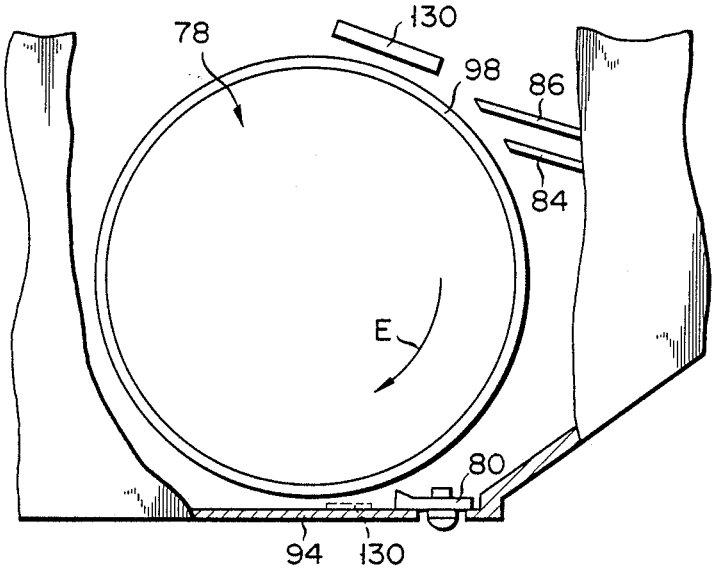
FIG. 8 is a longitudinal sectional view similar to FIG. 7, schematically showing a modification of the disposition of the magnetic member in the reversal developing type developing apparatus according to the third embodiment of the present invention.

A third embodiment of the present invention will be described with reference to FIGS. 6 to 8. FIG. 6 is a longitudinal sectional view schematically showing an image forming apparatus having a reversal developing type developing apparatus according to the third embodiment. The image forming apparatus in FIG. 6 has substantially the same arrangement as in the image forming apparatus having the reversal developing type developing apparatus according to the second embodiment. The same reference numerals as in FIGS. 3 and 4 denote the same parts in FIGS. 6 to 8, and a detailed description thereof will be omitted.

In the third embodiment, magnetic member 130 is used in place of toner removal members 90 and 92 of the second embodiment. Magnetic member 130 is located near the outer surface of developing roller 78 in casing 94 of developing mechanism 74 in reversal developing type developing apparatus 64.

Magnetic member 130 is made of iron or the like and is magnetized by magnetic roller 96. The magnetic carrier around magnetic member 130 is attracted thereto, and carrier particles are continuously aligned like a chain around magnetic member 130, as indicated by white dots in FIG. 7. The chained magnetic carrier particles are filled in the gap between magnetic member 130 and sleeve 98 in roller 78 and scrape toner particles (indicated by black dots in FIG. 7) attached to the surface of sleeve 98 during its rotation. The removed toner particles are attached to the chain. Therefore, neither the toner layer is formed on the surface of sleeve 98 in roller 78 nor the thickness of the toner layer is increased.

In the reversal developing type developing apparatus of this embodiment, a gap (distance) between magnetic member 130 and the surface of sleeve 98 in roller 78 is set to be about 2.0 mm to about 5.0 mm. Magnetic member 130 is located downstream of first and second scrapers 84 and 86 in the developer conveying direction of roller 78, as shown in FIG. 6, and opposes first magnetic pole 100.

When toner image development is performed in the image forming apparatus having the construction described above, a high-contrast image free from the edge effect can be obtained for a solid black image. In addition, when continuous copying is performed with this apparatus, the initial copying state is maintained, thus proving that an insulating film caused by a toner layer is not formed on the outer surface of sleeve 98.

Various modifications may be made in the third embodiment. For example, as indicated by the broken line in FIG. 8, magnetic member 130 may be located downstream of doctor blade 80 in the developer conveying direction (indicated by arrow E) of roller 78. As indicated by the solid line in FIG. 8, even if magnetic member 130 is located upstream of scrapers 84 and 86, the same effect as in the above embodiment can be obtained. A plurality of magnetic members 130 may be provided for each developing roller 78.

The magnetic member according to the present invention is particularly effective in preventing the drawbacks inherent to the reversal developing type developing apparatus. However, the magnetic member according to the present invention may also be applied to a normal developing apparatus to produce a clearer image.

Figure 9:
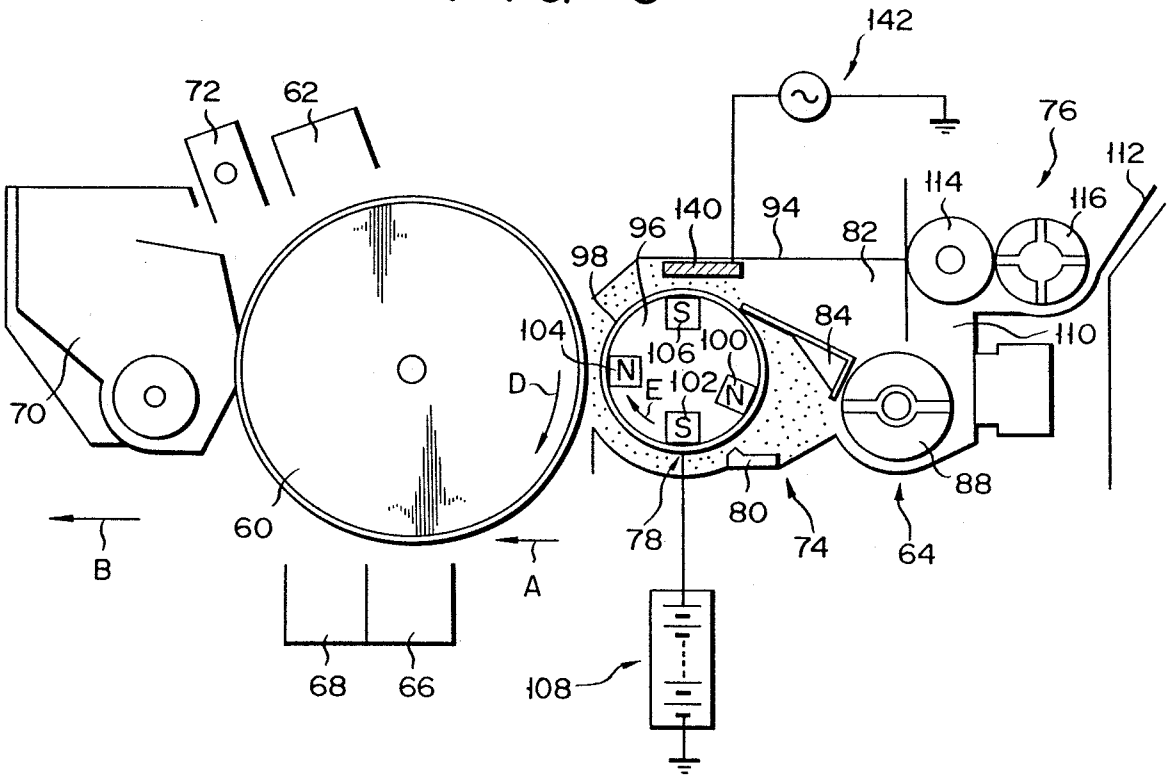
FIG. 9 is a longitudinal sectional view schematically showing an image forming apparatus having a reversal developing type developing apparatus according to a fourth embodiment of the present invention.

A fourth embodiment of the present invention will be described with reference to FIGS. 9 to 11. FIG. 9 is a longitudinal sectional view schematically showing an image forming apparatus having a reversal developing type developing apparatus according to the fourth embodiment of the present invention. The image forming apparatus in this embodiment has substantially the same arrangement as that of the image forming apparatus having the reversal developing type developing apparatus according to the second embodiment. The same reference numerals as in FIGS. 3 and 4 denote the same parts in FIGS. 9 to 11, and a detailed description thereof will be omitted.

In the fourth embodiment, electrode member 140 is used in place of toner removal members 90 and 92 in the second embodiment. Electrode member 140 is located near the outer surface of developing roller 78 in casing 94, in developing mechanism 74 of reversal developing type developing apparatus 64.

Electrode member 140 is made of iron and is connected to AC power source 142 to forcibly remove the toner particles from the surface of sleeve 98 in roller 78, as shown in FIG. 9.

In the reversal developing type developing apparatus according to this embodiment, electrode member 140 is located upstream of doctor blade 80 along the developer conveying direction of roller 78 and opposes fourth magnetic pole 106.

Figure 10:
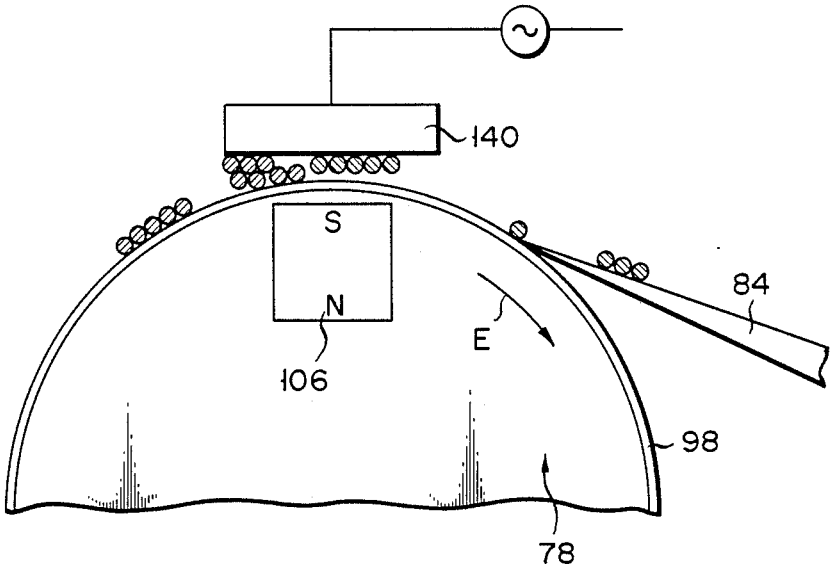
FIG. 10 is an enlarged longitudinal sectional view schematically showing only a portion near around an electrode member in the reversal developing type developing apparatus according to the fourth embodiment, so as to explain a toner separation function of the electrode member for removing the toner from a developing roller as a developer carrying body to which the toner is directly attached.
Figure 11:
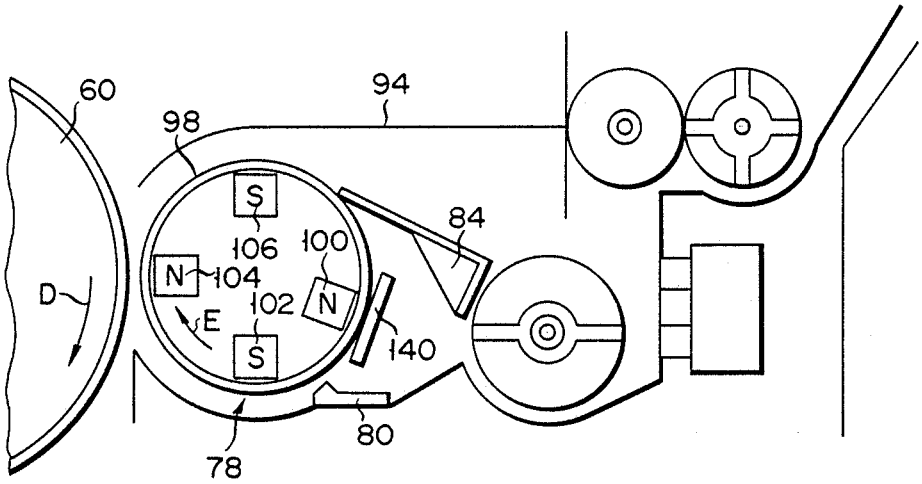
FIG. 11 is a longitudinal sectional view similar to FIG. 10, schematically showing a modification of the disposition of the electrode member in the reversal developing type developing apparatus according to the fourth embodiment.

FIG. 10 shows the principle for causing electrode member 140 to forcibly separate or remove the toner from the surface of sleeve 98 in roller 78. Electrode member 140 is brought into slight contact with the magnetic brush (toner) formed on the surface of sleeve 98 at a position corresponding to fourth magnetic pole 106. Black dots represent nonmagnetic toner particles. Even after development is completed, the toner directly attached to the surface of sleeve 98 in roller 78 is moved between sleeve 98 and electrode member 140 upon rotation of sleeve 98 along the direction of arrow E. In this case, if a negative voltage is applied to electrode member 140, the toner directly attached to sleeve 98 is attracted to electrode member 140, as shown in FIG. 10. Therefore, the toner is forcibly separated or removed from the surface of sleeve 98. The toner attracted to electrode member 140 is separated therefrom when a voltage applied to electrode member 140 is changed from the negative voltage to a positive voltage. The removed toner drops on sleeve 98 and is removed from sleeve 98 by scraper 84. According to this principle of operation, an AC voltage frequency is determined not to cause deposition of the toner on sleeve 98. The AC voltage application timing is a timing for applying a surface potential to drum 60 (e.g., in synchronism with ON operation of a copy start key if the image forming apparatus is a copying machine), or a timing for applying a developing bias to developing roller 78. The AC voltage is ½ or less of the developing bias voltage to obtain a better result.

Toner image development in the image forming apparatus having the reversal developing type developing apparatus provides a high-contrast image free from an edge effect, even for a solid black image. When continuous copying is performed in this apparatus, the initial copying state is maintained, thereby proving that an insulating film caused by a toner image is not formed on the surface of sleeve 98 in roller 78.

Various modifications may be made in the fourth embodiment. For example, as shown in FIG. 11, electrode member 140 may be located downstream of scraper 84 along the developer conveying direction (indicated by arrow E) of roller 78 to obtain the same effect as above. A plurality of electrode members 140 may be arranged for one developing roller 78.

In addition, electrode member 140 according to the present invention is particularly effective in preventing the drawbacks inherent to the reversal developing type developing apparatus. However, the electrode member according to the present invention may be applied to a normal developing apparatus to produce a clearer image.

Figure 12:
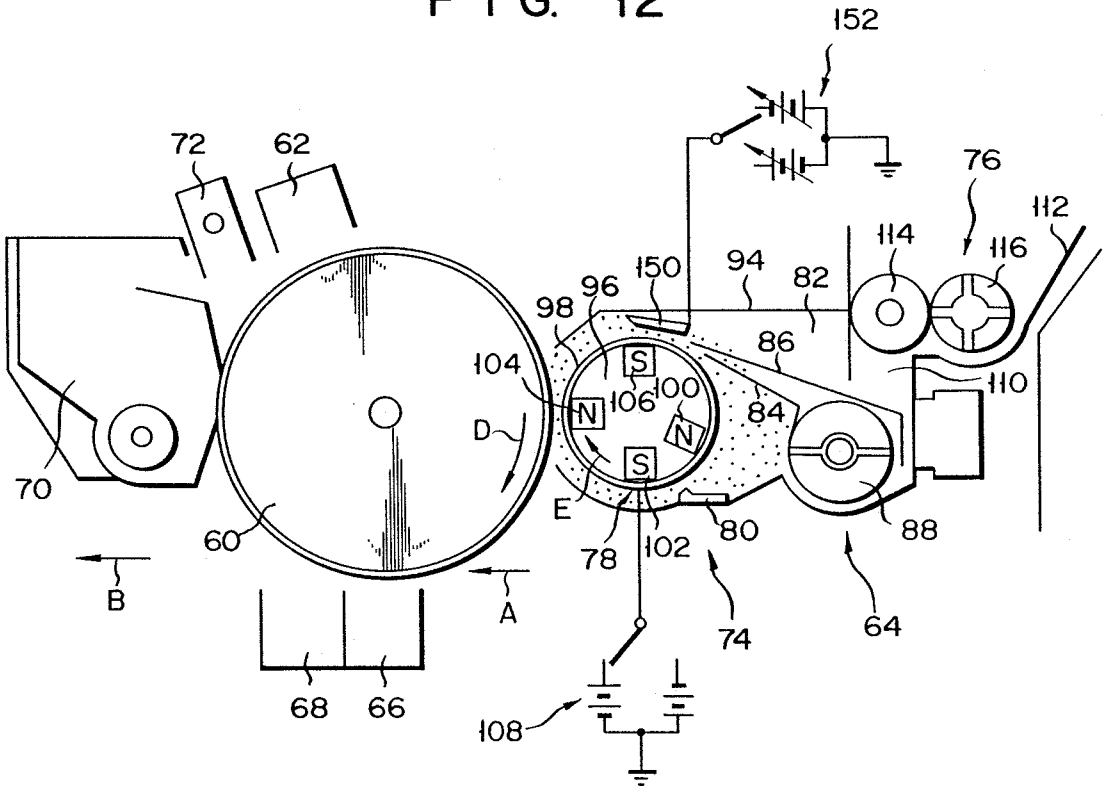
FIG. 12 is a longitudinal sectional view schematically showing an image forming apparatus having a developing apparatus according to a fifth embodiment of the present invention.

A fifth embodiment according to the present invention will be described in detail with reference to FIGS. 12 to 17. FIG. 12 is a longitudinal sectional view schematically showing an image forming apparatus having a developing apparatus according to the fifth embodiment. The image forming apparatus in the fifth embodiment is substantially the same as the image forming apparatus having the reversal developing type developing apparatus according to the second embodiment. The same reference numerals as in FIGS. 3 and 4 denote the same parts in FIGS. 12 to 17, and a detailed description thereof will be omitted.

In the fifth embodiment, electrode member 150 is used in place of toner removal members 90 and 92 in the second embodiment. Electrode member 150 is located near the outer surface of developing roller 78 in casing 94, in developing mechanism 74 of reversal developing type developing apparatus 64.

Electrode member 150 is connected to voltage applying means 152 to generate an electric field between developing roller 78 and electrode member 150. This electric field has a polarity opposite to that generated between photosensitive drum 60 and developing roller 78. Most of the surface of drum 60 has a surface potential of about 800 V for a normal original mainly having symbols (e.g., characters and numerals) and figures. A bias voltage of about 400 V is applied by bias applying means 108 to developing roller 78. The electric field generated between drum 60 and roller 78 is directed from drum 60 to roller 78. Voltage applying means 152 generates an electric field directed from roller 78 to electrode member 150 arranged therebetween. To make this electric field, voltage applying means 152 apply a given voltage to electrode member 150. The given voltage is lower than at least the developing bias voltage applied to roller 78. It should be noted that voltage applying means 152 can generate positive or negative variable voltages.

In this embodiment, a gap between developing roller 78 and electrode member 150 is 2.1 mm, a gap between roller 78 and the developing area of the surface of drum 60 is 2.0 mm, and a gap between roller 78 and doctor blade 80 is 1.85 mm. Electrode member 150 is located downstream of the developing position along the developer conveying direction of roller 78, and opposes fourth magnetic pole 106.

In the developing apparatus of this embodiment, the electric field directed from roller 78 to electrode member 150 is formed to attract the toner from the outer surface of the sleeve 98 in roller 78 to electrode member 150 after development is completed. Therefore, neither the toner layer is formed on the surface of sleeve 98 of roller 78 nor the thickness of the toner layer is increased.

Figure 13:
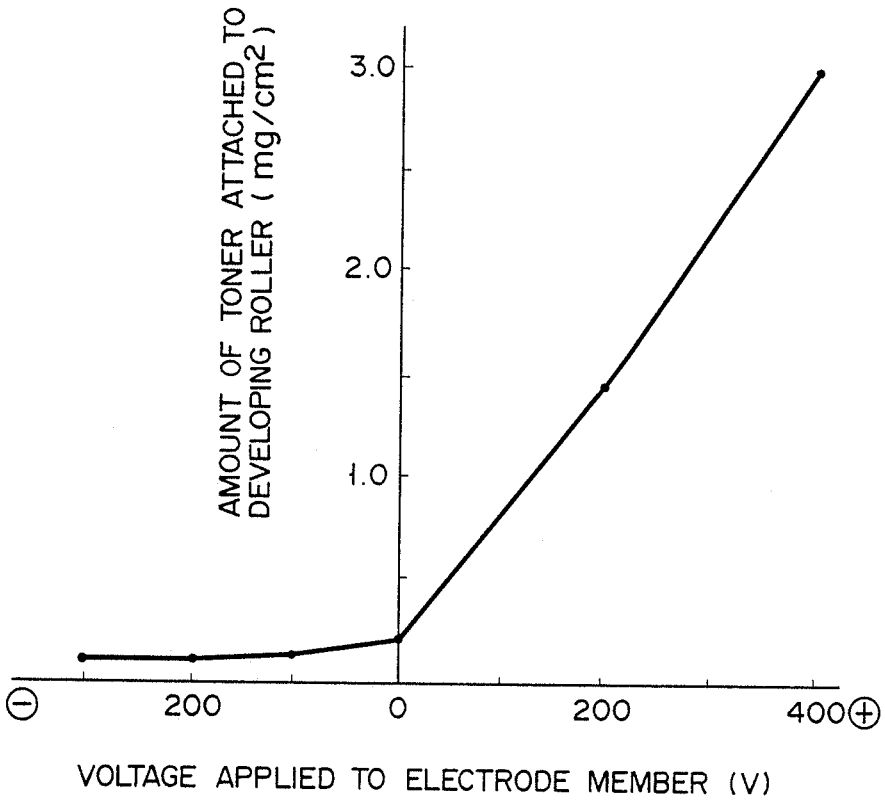
FIG. 13 is a graph showing relationship between an amount of toner attached to the developing roller and a voltage applied to the electrode member in the developing apparatus FIG. 12.

Test results are shown in FIG. 13 for explaining the relationship between the amount of toner attached to the surface of roller 78 and a voltage applied to electrode member 150 if the surface potential of drum 60 is 800 V and the developing bias voltage is 400 V. As is apparent from FIG. 13, upon application of a voltage lower than the developing bias voltage of 400 to electrode member 150, the amount of toner attached to roller 78 is found to be reduced. In particular, the larger the potential difference between the developing bias voltage and the voltage applied to electrode member 150 is, i.e., the stronger the electric field formed between electrode member 150 and developing roller 78 is, the smaller the amount of toner attached to roller 78. In addition, if a voltage having a polarity opposite to that of the developing bias voltage is applied to the electrode member 150, the amount is found to be further reduced, thereby obtaining a good effect. In the developing apparatus of this embodiment, a good effect can be obtained even if electrode member 150 is simply grounded. In this case, the overall construction is simplified.

Since electrode member 150 is located downstream of the developing position along the developer conveying direction of roller 78 in the developing apparatus of this embodiment, the developer attracted from the surface of roller 78 to electrode member 150 is forcibly pushed into developer storage 82 from the gap between electrode member 150 and sleeve 98 by the developer continuously conveyed toward electrode member 150 with the rotation of sleeve 31. Therefore, the developer can be satisfactorily collected in storage 82.

Figure 14:
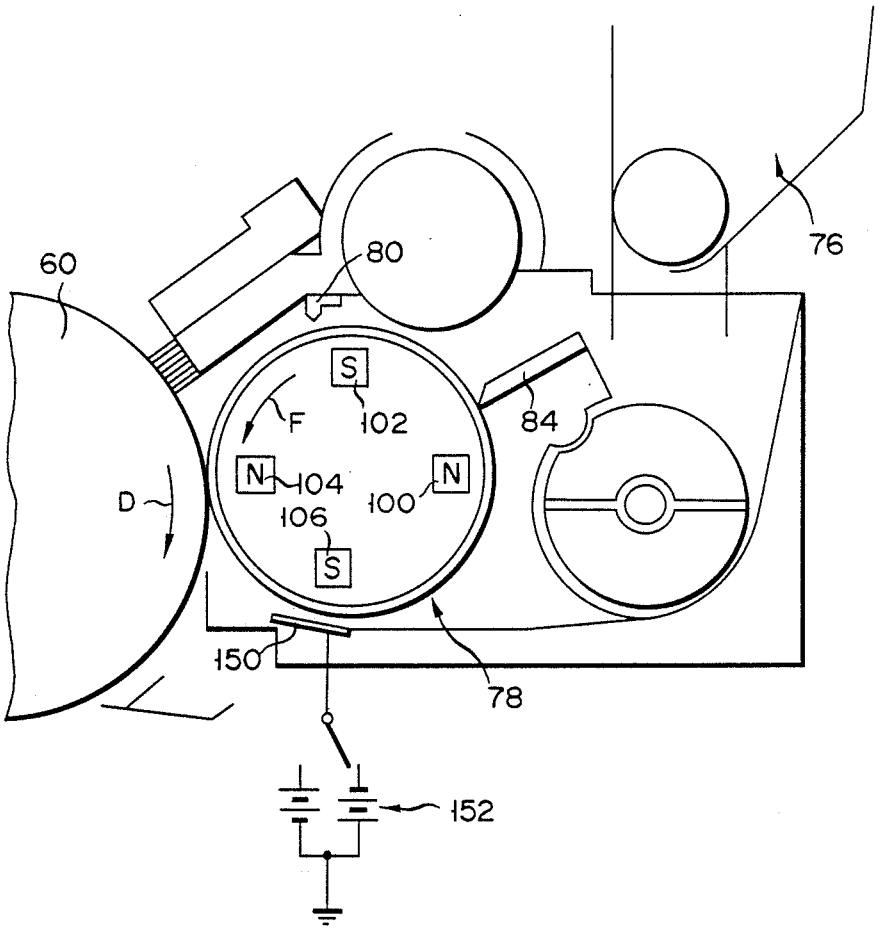
FIG. 14 is a longitudinal sectional view similar to FIG. 12, schematically showing the disposition of the electrode member when a rotational direction of the developing roller is aligned with that of the photosensitive drum in the developing apparatus in FIG. 12.
Figure 15:
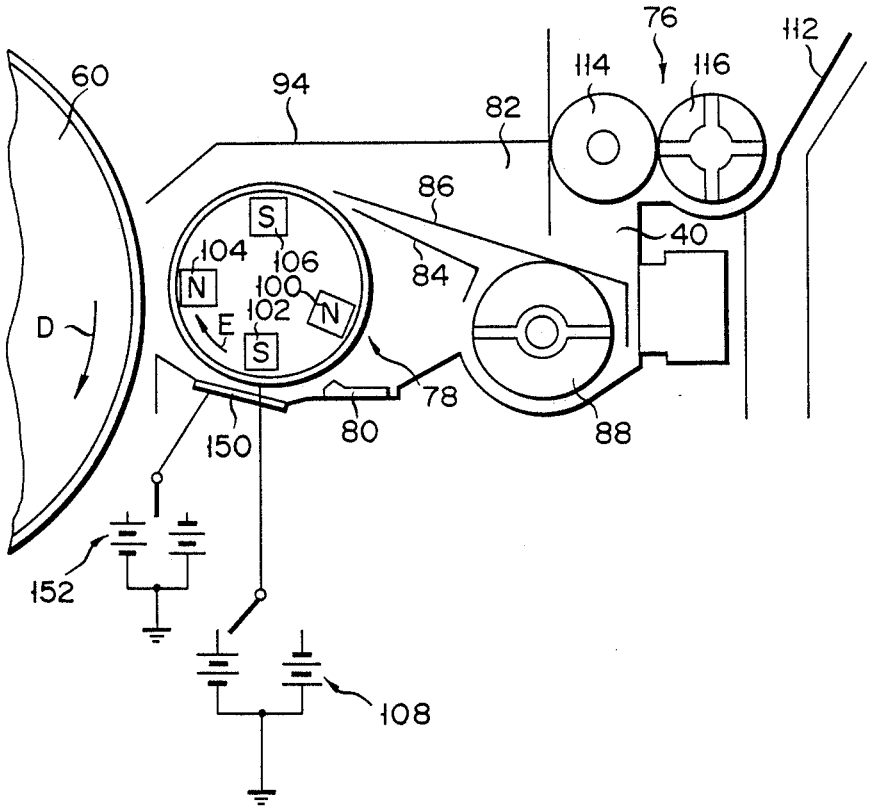
FIG. 15 is a longitudinal sectional view similar to FIG. 12, schematically showing a first modification wherein the electrode member in FIG. 12 is constituted by part of a casing of a developing mechanism.

As shown in FIG. 14, if the rotational direction of roller 78 is indicated by arrow F and is the same as arrow D of drum 60, electrode member 150 may be located below developing roller 78 to obtain the same effect as in the above embodiment. However, the locations of electrode member 150 are not limited to the positions indicated by the above embodiment and its modification. If electrode member 150 opposes any one of magnetic poles 100, 102, and 106, excluding pole 104 located at the developing position, the toner layer is not formed on the developing roller. For example, as shown in FIG. 15, electrode member 150 may be located upstream of the developing position along the developer conveying direction of roller 78. In this case, a means must be arranged to prevent leakage of the developer attracted to electrode member 150 from the gap between the left end of casing 94 and drum 60 in the continuous copying mode.

Toner image development in the developing apparatus having the arrangement described above provides a highcontrast image free from an edge effect, even for a solid black image. When continuous copying is performed in this apparatus, the initial copying state is maintained, thus proving that an insulating film caused by a toner layer is not formed on the outer surface of sleeve 98.

Figure 16:
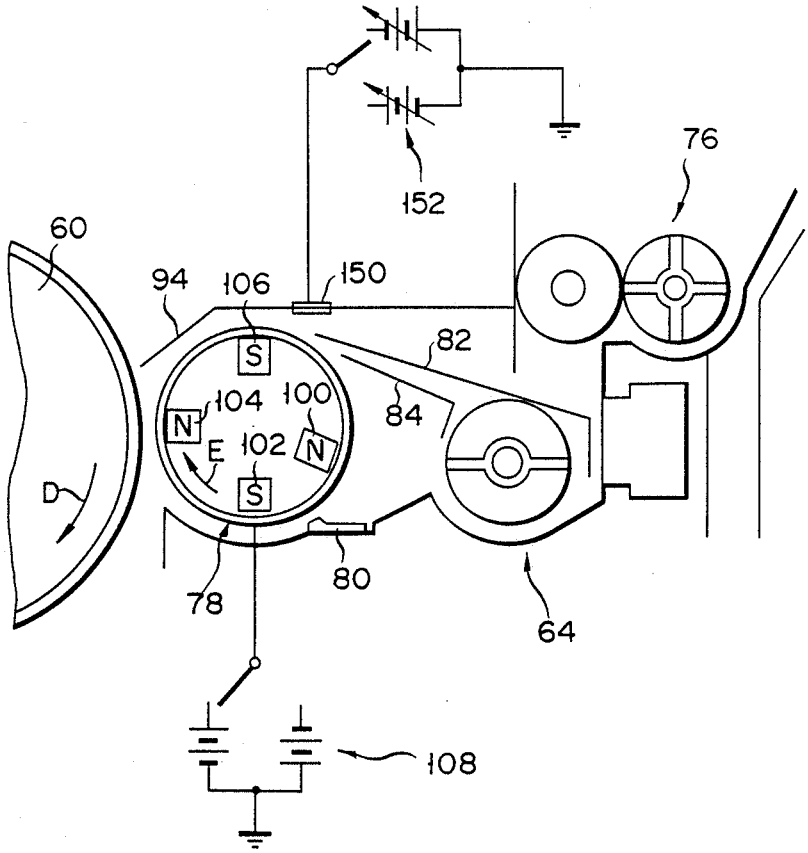
FIG. 16 is a longitudinal sectional view similar to FIG. 12, schematically showing a second modification wherein the electrode member in FIG. 12 is constituted by part of a casing of a developing mechanism.
Figure 17:
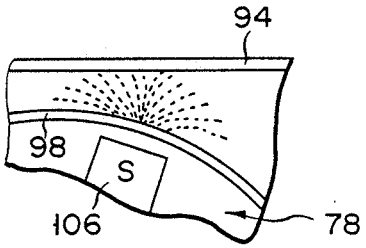
FIG. 17 is an enlarged longitudinal sectional view schematically showing only a portion near around the electrode member in FIG. 16 so as to explain its behavior.

Various modifications may be made in the fifth embodiment. For example, electrode member 150 may be constituted by part of casing 94 extending in proximity of roller 78, as shown in FIG. 16. In this case, voltage applying means 152 applies the above-mentioned voltage to casing 94. With this arrangement, separate electrode member 150 need not be used, thus simplifying the overall construction and obtaining a compact developing apparatus. In addition, the extended portion of casing 94 may be disposed to contact the leading edge of the brush-like developer at a position corresponding to fourth magnetic pole 106, as shown in FIG. 17, so that scattering of the toner attracted from the outer surface of sleeve 98 in roller 78 to electrode member 150 can be effectively prevented. Therefore, the developer can be efficiently collected in developer storage 82.

The present invention is not limited to a developing apparatus using a two-component developer but can also be applied to a developing apparatus using a one-component developer. Furthermore, although electrode member 150 according to the present invention is particularly effective in eliminating the drawbacks inherent to the reversal developing type developing apparatus, it can also be applied to a normal developing type developing apparatus to produce a clearer image. Even if an N-type photosensitive drum subjected to negative charging is used, the charging potential of drum 60 and the voltage applied by voltage applying means 152 in association with the developing bias voltage at roller 78 can be properly determined to generate an electric field between roller 78 and electrode member 150 so as to have a polarity opposite to that generated between drum 60 and roller 78, thereby obtaining the same effect as in the above embodiment.

What is claimed is:

1. A developing apparatus for developing a charged latent image formed on an image carrying body with a developer including toners and carriers, comprising:

a casing for holding the developer;

a developer carrying body for carrying the developer supplied from said casing, and conveying the developer from said casing to the image carrying body so as to develop the charged latent image formed on the image carrying body with the developer;

means for controlling the thickness of the developer carried on said developer carrying body to a predetermined value;

means for removing the developer which is carried on said developer carrying body after the end of developing operation, and returning the removed developer into said casing; and means for removing toner particles attached on said developer carrying body from said developer carrying body, said toner removing means being provided independent of said developer removing means and including an electrode member slightly spaced apart from said developer carrying body, and voltage applying means for alternately applying voltages of opposite polarities to said electrode member so as to attract the toner, directly attached to said developer carrying body, from said developer carrying body to said electrode member, and then to separate the toner, once attracted to said electrode member, from said electrode member, the separated toner returning to said casing.

2. An apparatus according to claim 1, wherein said voltage applying means applies A voltage to said electrode member.

3. An apparatus according to claim 1, wherein said electrode member is located downstream of a developing position, wherein said developer carrying body makes the developing operation to the image carrying body in the developer conveying direction of said developer carrying body.

4. An apparatus according to claim 1, wherein said developer carrying body has a magnetic pole for carrying and conveying the developer, and said electrode member faces said magnetic pole.

5. An apparatus according to claim 1, wherein said voltage applying means grounds said electrode member.

6. An apparatus according to claim 1, wherein said electrode member is constituted by part of said casing.

7. An apparatus according to claim 1, wherein the magnitude of the voltage applied by said voltage applying means on said electrode member is smaller than that of the voltage applied on said developer carrying body to develop the charged latent image formed on the image carrying body with the developer carried on said developer carrying body.

8. An apparatus according to claim 7 wherein the polarity of the voltage, applied on said electrode member by said voltage applying means to attract the toner which has been attached on said developer carrying boy after developing operation, is opposite to that of the voltage applied on said developer carrying body.

9. An apparatus according to claim 1, said voltage applying means further including a pair of DC current sources which supply DC voltages of opposite polarities and switching means for alternately connecting the electrode member to either one of the pair of DC current sources.

* * * * *